United States Patent [19]

Diener

[11] 3,991,144

[45] Nov. 9, 1976

[54] CARBURETOR FOR AN OTTO CYCLE ENGINE

[75] Inventor: Rudolf Diener, Zurich, Switzerland

[73] Assignee: Autoelektronik AG, Chur, Switzerland

[22] Filed: May 13, 1974

[21] Appl. No.: 469,560

[30] Foreign Application Priority Data

| | | |
|---|---|---|
| June 1, 1973 | Switzerland | 7972/73 |
| Jan. 17, 1974 | Switzerland | 632/74 |
| Mar. 19, 1974 | Switzerland | 3772/74 |

[52] U.S. Cl. ..... 261/36 A; 261/63; 261/88; 239/222.15

[51] Int. Cl.[2] ..... F02M 37/04

[58] Field of Search ..... 261/88, 89, 36 A, 63, 261/121 A, 91; 239/214, 222.11, 222.13, 222.15, 222.17, 222.19

[56] References Cited

UNITED STATES PATENTS

| | | | |
|---|---|---|---|
| 1,137,238 | 4/1915 | Sherman | 261/91 |
| 1,150,115 | 8/1915 | Heinze, Jr. | 261/89 X |
| 2,078,250 | 4/1937 | Hurlburt | 261/88 |
| 2,695,029 | 11/1954 | Bruegger | 261/36 A X |
| 2,899,943 | 8/1959 | Haensel et al. | 261/65 X |
| 3,369,758 | 2/1968 | Hruby, Jr. | 239/214 X |
| 3,669,424 | 6/1972 | Shiobara et al. | 261/63 X |

FOREIGN PATENTS OR APPLICATIONS

| | | | |
|---|---|---|---|
| 145,927 | 7/1920 | United Kingdom | 261/88 |

*Primary Examiner*—Tim R. Miles
*Assistant Examiner*—William Cuchlinkski, Jr.
*Attorney, Agent, or Firm*—O'Brien & Marks

[57] ABSTRACT

A carburetor for an Otto cycle engine comprising a mixing compartment through which flows a suction air current regulated by means of a regulating valve. In the mixing compartment there is prepared from the dosed fuel delivered by nozzle means a fuel-air mixture for the Otto cycle engine. Within the mixing compartment there is arranged an impeller driven by the suction air current, this impeller containing a fuel compartment into which opens a fuel delivery channel. The nozzle means embody nozzle channels which lead away from the fuel compartment, these nozzle channels rotating with the impeller and fuel is sprayed from spray nozzles of the nozzle channels during rotation of the impeller owing to an excess pressure brought about by the centrifugal forces, the fuel being sprayed out of the fuel compartment into the mixing compartment.

16 Claims, 7 Drawing Figures

Fig. 2
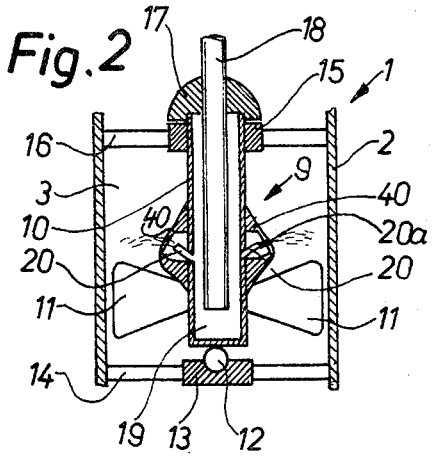
Fig. 3
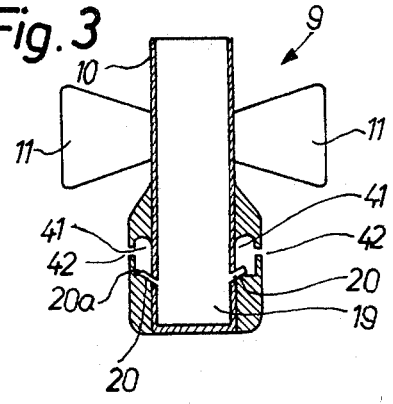
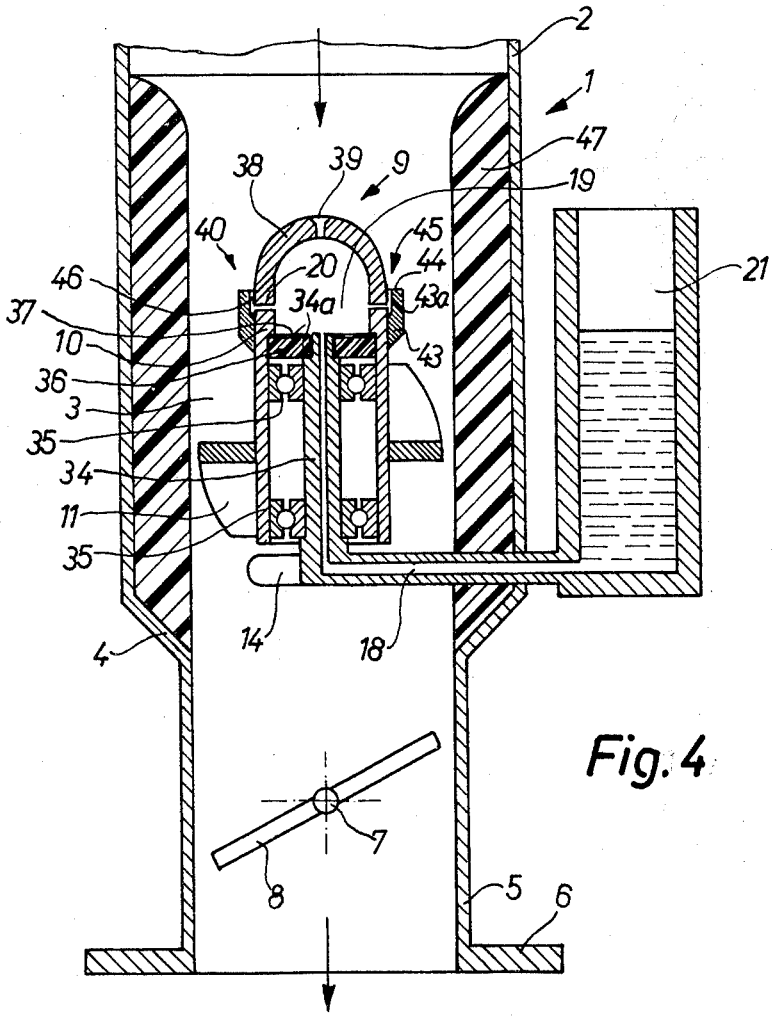
Fig. 4

CARBURETOR FOR AN OTTO CYCLE ENGINE

BACKGROUND OF THE INVENTION

The present invention relates to a new and improved construction of carburetor for an Otto cycle engine or Otto carburetor engine, which carburetor is of the type comprising a mixing compartment through which flows a suction air current regulated by a regulating valve, and within the mixing compartment there is prepared the fuel which is infed in a dosed manner by nozzles for forming the fuel-air mixture for the Otto cycle engine.

One of the primary efforts which is being made at the present time is to reduce the proportion of noxious constituents contained in the exhaust gases of Otto cycle engines. Recently a great deal of effort has been expended to solve this problem and, accordingly, there have become known in this particular field of technology many different processes and apparatuses which are intended to produce exhaust gases having a low ccontent of noxious or harmful substances, in fact even totally free of such noxious substances. It has been found that even when using a conventional carburetor operating at constant conditions, it is possible to obtain exhaust gases which at least are almost free of noxious substances, if the carburetor is adjusted very accurately. The high proportion of noxious substanes in the exhaust gases of an Otto cycle engine therefore is apparently primarily attributable to improper dosage of the fuel, i.e. it is not so much the engine itself which is responsible for the formation of the noxious substances, primarily rather the carburetor and the injection device, and even in a conventional engine without any changes carried out thereat, considerably better results can be expected in this regard if the fuel is exactly dosed as a s function of the operating conditions.

For the combustion of 1 kilogram fuel in an Otto cycle engine, depending upon the operating conditions (idling, partial load, full load) there are required approximately 11 to 18 kilograms of air. Preparation of the fuel-air mixture occurs in the mixing compartment where there is distrubuted as uniformly as possible a predetermined quantity of fuel into a sucked-up quantity of air. The addition of fuel is generally requlated primarily as a function of the negative pressure generated in the suction conduit. The dependency of the sucked-up quantity of air upon the negative pressure for conventional carburetors can be expressed by a rather complicated equation. Generally considered there can be used for this purpose a second power function, and the quantity of fuel more or less linearly increases with the quantity of air. Thus, for such type carburetor a considerable expenditure is required in order to realize an exact dosing of the fuel. Hence, it is hardly possible to solve the prevailing porblem by means of a pressure-dependent regulated dosage of the fuel. Furthermore, a number of other constructions of carburetors have become known or proposed, which however likewise are associated with the drawback that they are inaccurate in operation and/or expensive.

Essential for the operation of an Otto cycle engine is, however, not only the dosage of the fuel but also the preparation of the fuel-air mixture. For judging the quality of the obtained fuel-air mixture two criteria are sufficient in practice: particle size and condensation of fuel at the walls of the carburetor. The fuel particles or droplets should possess a diameter of about 10to 20 $\mu$ m and the walls of the carburetor should be dry in any case. If there is present too good "carburization" of the fuel with a particle size below 10 $\mu$ m then the efficiency of the engine drops, and with poor carburization with fuel droplet or particle diameters exceeding 20 $\mu$ m and condensation of fuel at the carburetor walls the combustion becomes faulty, such incomplete combustion of the fuel being considered the cause for the noxious CH-compounds (hydrocarbon compounds) which are present at the exhaust gases. In the case of an ideal prepared fuel-air mixture it thus would be necessary to uniformly distribute in the sucked-up air small fuel droplets or particles of the same predetermined size and which must be at rest relative to the flowing air. Such ideal fuel-air mixture basically cannot be produced with an injection carburetor, yet in the interest of environmental controls it is necessary that there be obtained as close as possible approximation of such ideal conditions.

SUMMARY OF THE INVENTION

Hence, it is a primary object of the present invention to provide an improved carburetor for an internal combustion engine, especially an Otto cycle engine, which extensively overcomes the shortcomings of the prior art proposals.

Another and more specific object of the present invention relates to a new and improved construction of carburetor for an Otto cycle engine wherein there is eliminated the dosing of the fuel as a function of the negative pressure, and further wherein by means of a regulation employing simple means and conforming to the linear dependency of the fuel quantity and the sucked-up quantity of air there can be obtained a satisfactorily accurate dosage of the fuel and which additionally delivers a properly prepared fuel-air mixture.

Now in order to implement these and still further objects of the invention, which will become more readily apparent as the description proceeds, the carburetor of the development of this invention is manifested by the features that an impeller driven by the suction air current is arranged in the mixing compartment, and that the impeller contains a fuel compartment into which opens a fuel delivery channel. Lateral nozzle channels of the nozzles lead away from the fuel compartment and rotate with the impeller and from the injection nozzles thereof, during rotation of the impeller, due to the excess pressure brought about by the centrifugal force, fuel is injected or sprayed out of the fuel compartment into the mixing compartment. Owing to the dependency of the quantity of fuel flowing per second out of the nozzle channels upon the excess pressure in the fuel compartment and the dependency of the excess pressure in the fuel compartment upon the rotational speed per second of the impeller, with the rotational speed of the impeller proportional to the air inflow velocity, the quantity of fuel flowing out of the injection nozzles per second at least in the first approximation is proportional to the quantity of air which is sucked-up per second. The fuel-spray jets emanating from the injection nozzles are curved in the form of spiral arms owing to the rotation of the nozzles, whereby their "rigidity" or "stiffness" increases with increasing rotational speed. By varying the number of nozzles, the nozzle cross-section, the spacing of the injection nozzles from the axis of rotation, the angle of attack of the vanes (rotational speed), it is easy to obtain a correct dosage of the fuel and, since also the atomization of the fuel is capable of being influenced by such parameters, it is equally possible to obtain good atmoization of the fuel.

However, it can happen that even with an optimized system the atomization of the fuel is associated with drawbacks, such as the fuel being too finely atomized (mist) at one rotational speed, for instance during idling, and that there are present too large size fuel particles at high rotational speeds, wetting of the carburetor walls and the like. As a further manifestation of the invention it is contemplated for obtaining a fuel-air mixture which is properly prepared in each case to provide in front of each injection nozzle of the impeller an atomizer device in order to atomize in the mixing compartment the fuel-spray jets emanating from the injection nozzles. The atomization, i.e., the carburization of the fuel, therefore occurs independent of the dosage of the fuel by the nozzles and can be optimized by appropriate construction of the atomizer device. Such atomizer devices can essentially consist of conventional atomizer elements which are consturctionally modified for this purpose, such as impact elements, gaps, disks, edges and so forth or combinations of such features. For the construction of the atomizer devices it is of importance. that they rotate with the impeller in the mixing compartment through which flows the sucked-up air or suction air current, so that even with the aid of simple means it is already possible to obtain a satisfactory atomization of the fuel ejected out of the injection nozzles.

An atomizer device designed according to the invention which, during production of the carburetor is only associated with slightly increased costs, contemplates providing in front of each injection nozzle a hollow compartment which opens in the direction of the mixing compartment by means of a gap, and into which hollow compartment there opens the associated injection nozzle, and advantageously according to a preferred embodiment at or in the fuel compartment wall there is provided a ring-shaped hollow compartment which opens towards the mixing compartment by means of an annular gap, and into which ring-shaped hollow compartment there open all injection nozzles of the fuel compartment. The annular gap of such atomizer device can be loacted at a cylindrical jacket surface which is coaxially arranged with respect to the axis of rotation of the fuel compartment, i.e. can form an atomizer nozzle where the particle size of the atomized fuel is essentially determined by the gap width.

Even more favorable conditions as concerns economical fabrication and expecially easy optimization of the atomization of the fuel can be realized according to the teachings of the invention through the provision of an atomizer device of the type wherein the annular gap is located in a plane which is essentially perpendicular to the axis of rotation of the fuel compartment, i.e. the hollow compartment is open in the direction of the axis of rotation, and according to the invention the annular or ring-shaped gap is bounded at the outside by a ring-shaped or annular end surface loacted at the gap plane. The position of the annular end surface with regard to the injection nozzles, the properties of the surface of the annular end surface as well as its width in this case affect the atomization of the fuel and can be easily experimentally varied for optimization, since such type atomizer device simply can consist of a profile or shaped member corresponding in shape to a ring and arranged in front of the injection nozzles.

As already mentioned, also at low temperatures dry carburetor walls constitute a criterium for a small content of noxious substances, especially CH-compounds, in the exhaust gases. Of course, fuels which escape in an unatomized condition from the fuel compartment, for instance through the bearings of the impeller are harmful or noxious. According to a further aspect of the invention the impeller possesses a cylindrical hollow shaft which is closed or sealed at one end and at the closed end the fuel compartment is separated by an intermediate wall. A fuel infeed or delivery line opens into the fuel compartment. Additionally, there are provided as the nozzle channels radial bores at the jacket or outer wall of the fuel compartment. As the atomizer device the cylindrical hollow shaft of the impeller, at the region of the nozzle channels, carries a ring-shaped attachment with an endless or closed inner ring recess which forms the ring-shaped hollow compartment and the ring-shaped or annular gap. With such construction of the impeller, favoring economical series fabrication i.e. mass production, the possibility that the fuel can arrive at the mixing compartment without being atomized, is limited to the only possible leakage location of the mouth region of the stationary fuel-infeed or delivery line in the rotating fuel compartment. Moreover, the spacing of the injection nozzles from the axis of rotation of the fuel compartment is relatively small which, as has been found, is advantageous for the atomization of the fuel and additionally renders possible further advantageous measures. The danger of fuel escaping from the aforementioned mouth location of the fuel-infeed or delivery line is overcome by the invention in that the impeller with its hollow shaft is rotatably mounted by means of for instance ball bearings in the mixing compartment upon a tubular element of the fuel delivery line, — which tubular element is coaxially arranged with regard to the mixing compartment— and the sealed or closed end of the hollow shaft containing the fuel compartment is upwardly directed towards the inflowing suction air current and the end of the coaxial tubular element of the fuel infeed line is guided with slight play through the intermediate wall separating the fuel compartment in the hollow shaft. During rotation of the impeller the fuel is delivered from the fuel delivery line into the fuel compartment, the inflowing fuel, owing to the effective centrifugal force, so to speak being propelled over the narrow gap between the end of the tubular element and the intermediate wall and no fuel pressure builds up at such gap.

A further advantageous feature of the invention from the standpoint of providing a reliable seal resides in the features that the intermediate wall is equipped with a surface which repels the fuel or is produced or fabricated from a material which repels fuel, for instance such as "TEFLON," whereby there is also eliminated the "sucking-off" of fuel occurring in the case of a fuel-imbued surface owing to surface- and capillary forces. In order to insure for the distribution of the fuel at the fuel compartment with the use of such an intermediate wall the latter is advantageously equipped with, for instance, radial grooves at the side thereof located in the fuel compartment.

For proper dosing of the fuel during operation of the engine the impeller must react to each adjustment of the regulating valve with a sufficiently rapid change of its rotational speed. According to a further aspect of the invention there is contemplated to provide for the carburetor a conventional housing consisting of a cylindrical upper portion equipped with the mixing compartment and a valve support containing the regulating valve, whereby however the upper portion of the housing forwardly of the mixing compartment and the impeller arranged therein possesses a larger diameter and at the region of the mixing compartment possesses the same diameter as the valve support. As a result, with favorable flow conditions there is realized for the impeller which fills out the entire flow cross-section a relatively smaller diameter and owing to the greater speed of the sucked-up air at the constricted region there is realized a sufficiently high rotational speed of the impeller, even during idling. In the case of nozzle channels constructed in the form of radial bores at the fuel compartment the injection nozzles possess sufficient spacing from the mixing compartment walls, which walls advantageously have a fuel-repelling surface, so that such also remains dry at low temperatures. In order to prevent that the atomized fuel will be propelled onto the walls of the mixing compartment by the rotating impeller vanes, the vanes of the impeller are arranged at the hollow shaft above the nozzle channels at the region of the fuel compartment, and the fuel compartment possesses an appropriate length in axial direction.

Further aspects of the invention concern the supply of the fuel compartment with fuel and the adjustment of th carburetor.

As mentioned above one of the decisive advantages of the carburetor constructions of this development incorporating an impeller driven by the sucked-up air current and a fuel compartment possessing injection nozzles and rotating with the impeller, resides in the fact that the quantity of fuel delivered by the nozzles is proportional to the sucked-up quantity of air and thus to the rotational speed of the impeller. It has been found that with the previously discussed carburetor constructions, especially at high rotational speeds of the impeller, the proportionality factor can exhibit certain fluctuations, by virture of which the linearity of the carburetor under full load, while not decisively impaired, is still noticeably affected. Such fluctuations are not caused by the carburetor system itself, rather by irregularities in the supply of the injection nozzles with fuel.

Hence, it is a further object of the invention to overcome this drawback.

A still further object of the invention is directed to improving upon the carburetor constructions of the previously mentioned type without the need for any considerable expenditure and in a manner that also in the higher rotational speed ranges of the impeller, during full load of the engine, there is insured for satisfactory linearity.

Now in order to implement these last-mentioned objectives of the invention there are contemplated further constructions of the carburetor wherein at the intermediate wall in the hollow shaft separating the fuel compartment there is arranged a conveying or feed pump which rotates together with the hollow shaft. At the suction opening of the conveying pump there is located the outlet opening of the fuel delivery line. The conveying pump can be of simple constructional design, preferably embodies a ring-shaped pump component which is substantially coaxially arranged with respect to the tubular element of the fuel delivery line. This pump component may be equipped with radial bores or coaxially arranged bucket wheel means, and wherein the ring-shaped pump component or the bucket wheel means, as the case may be, and the intermediate wall can be fabricated of plastic as one-piece.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 schematically illustrates an impeller arranged in a carburetor mixing compartment and equipped with a fuel chamber or compartment, injection nozzles and atomizer devices arranged in front of the injection nozzles.

FIG. 3 schematically illustrates a different embodiment of impeller equipped with atomizer devices which possess a hollow compartment which opens in the direction of the mixing compartment by means of a gap;

FIG. 4 is a longitudinal sectional view through a construction of carburetor equipped with impeller and atomizer device according to a further variant of the invention;

DETAILED DESCRIPTION OF THE PREFERRED EMBODIMENTS

Figure 1:
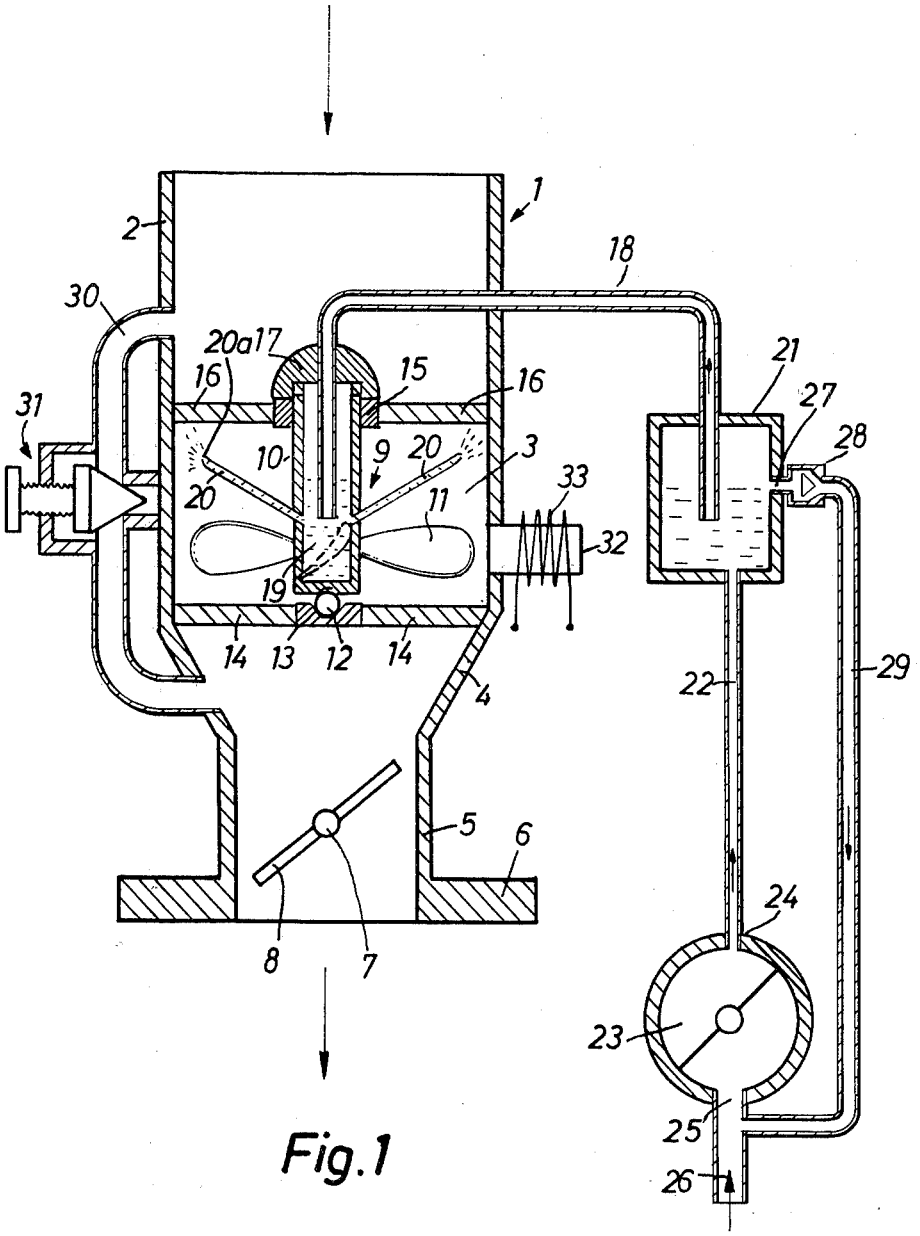
FIG. 1 schematically illustrates in longitudinal sectional view a carburetor designed according to the teachings of the present invention.

Describing now the drawings, as should be apparent from the showing of FIG. 1 the essential components of the carburetor are assembled in or at a substantially tubular-shaped housing 1. The carburetor housing 1 comprises a substantially cylindrical upper housing portion 2, containing a mixing compartment or chamber 3, which transforms via a substantially conical intermediate portion or member 4 into a valve support 5 of smaller diameter. The valve support 5 contains a regulating valve or flap member 8 which is adjustable about an axle or shaft 7. The valve support 5 carries an outer flange 6 for the convenient attachment of the housing 1 at the suction conduit (not shown) of the engine. An air filter, not particularly shown but likewise of conventional design, is mounted upon the upper housing portion 2.

In the mixing compartment or chamber 3 there is mounted an impeller which has been conveniently designated in its entirety by reference character 9. In the illustrated exemplary embodiment under discussion, the impeller 9 possesses a hollow shaft constructed in the form of a hollow cylinder 10 closed at its lower end. This hollow shaft 10 is rotatably mounted in the mixing compartment or chamber 3 about an axis of rotation which is essentially coaxially arranged with respect to the lengthwise axis of the chamber 3. At the depicted lower sealed or closed end the shaft 10, constituted by the hollow cylinder, is supported by a bearing ball 12 at a bearing 13 which is retained by radial webs or struts 14 secured to the inner wall of the upper housing portion 2. At the upper end the hollow cylinder-shaft 10 is guided in a suitable bearing 15, for instance a ball bearing likewise retained by radial webs ro struts 16 secured to the inner wall of the upper housing portion 2. The radial webs or struts 14 and 16 advantageously possess an aerodynamic profile, so that they do not constitute any appreciable resistance for the suction air current flowing through the mixing compartment 3. A closure cap 17 or equivalent structure which is secured, for instance, to the upper bearing 15 seals the shaft 10 at its upper end and a tubular conduit or channel 18 guided through the closure cap 17 and through the wall of the upper housing postion 2 connects the inner or internal compartment of the shaft 10 with a compensating or equalizing compartment 21. This equalizing compartment or chamber 21 is connected via a tubular conduit or pipe 22 with outlet 24 of a fuel delivery pump 23 of conventional design.

Fuel is delivered from the compensating or equalizing compartment 21 through the tubular conduit or channel 18 into the hollow shaft 10, the inner compartment of which forms a fuel compartment 19. Above the impeller vanes 11 two nozzle channels 20 upwardly lead away from the fuel compartment 19 at an inclination or slant, these nozzle channels 20 are situated diametrically opposite one another in the exemplary arrangement shown in FIG. 1. The nozzle channels 20 can be, for instance, small tubular pipes which are mounted at the hollow shaft 10. The diameter of the nozzle openings 20*a* amounts to, for instance, 0.1 to 0.2 millimeters.

The compensation or compensating compartment 21 possesses a laterally arranged overflow opening 27 connected through the agency of a valve 28 via an overflow line or conduit 29 with inlet 25 of the fuel delivery or feed pump 23. Furthermore, a fuel supply line or conduit 26 is connected with this inlet 25 of the fuel delivery pump 23.

The compensating or equalizing compartment 21 is arranged, with regard to the impeller 9, such that its overflow opening 27 is located somewhat below the horizontal plane in which there are located the nozzle openings or injection nozzles 20*a* of the nozzle channels 20. If, with the valve 28 open, the compensation compartment 21, the tubular conduit 18 and the fuel compartment 19 receive fuel, then the level of the fuel, with the impeller wheel 9 stationary, is only slightly below the injection nozzles 20*a*, and no fuel escapes from such injection nozzles 20*a* into the mixing compartment 3.

Now to the extent that the heretofore discussed construction of carburetor of this development has been described up to this point its mode of operation will now be considered and is as follows:

When starting the engine the valve 28 is briefly closed. The fuel which is delivered by the feed or delivery pump 23 fills the compensation compartment 21 and via the tubular conduit 18 also fills the fuel compartment 19 of the impeller 9. By means of the regulation valve 8 the internal throughflow passage of the valve support 5 is somewhat opened and the suction air current flows through the carburetor housing 1, which in turn places into rotation the impeller 9. Owing to the action of the suction air current, which at this time is relatively weak, the impeller 9 only rotates relatively slowly and the pressure in the fuel compartment 19 is essentially determined by the pump pressure of the fuel delivery or feed pump 23. This has the purpose that upon starting the engine there is prepared a rich fuel-air mixture, which is desired at this time, due to the injection of a suitable quantity of fuel into the mixing compartment 3. After starting the engine the valve 28 is opened, so that fuel flows out of the compensation compartment 21 through the overflow line or conduit 29 and the level of the fuel in the compensation compartment 21 and in the fuel compartment 19 within the impeller 9 adjusts itself to a constant level determined by the overflow opening or port 27. The excess pressure internally of the fuel compartment 19 is now primarily governed by the centrifugal force which prevails during rotation of the impeller 9.

In consideration of the foregoing there can be enumerated the following relationships:

a. At the impeller 9 its rotationa speed per second $n$ is proportional to the inflow speed and therefore proportional to the air-throughflow quantity per second $Q_L$.

b. The excess pressure internally of the fuel compartment 19 changes by virtue of the centrifugal force as a function of the square of the angular velocity $u = 2\pi n$.

c. The quantity of fuel per second $Q_K$ which flows out of the nozzle channels 20 and specifically flowing out of the injection nozzles 20*a* thereof changes as a function of the square root of the excess pressure in the fuel compartment 19.

As a result there is realized the following:

the quantity of fuel per second $Q_K$ which flows out of the nozzle channels 20 is proportional to the quantity per second of the air-throughflow $Q_L$. Such essentially linear function between the quantity of air and the quantity of fuel renders possible an exact dosing of the fuel, wherein the accuracy is practically the same over the entire range of the suction air current-speeds. It is thus satisfactory if the carburetor is correctly adjusted at its operating point.

For the adjustment of the carburetor there is provided, for the exemplary embodiment under discussion, for the mixing compartment 3 an auxiliary air channel 30, the free flow cross-sectional or cross-sectional area of which can be changed by an adjustment or setting screw 31, so that there can be branched-off from the suction air current a certain proportion or part thereof and thus there can be adjusted the speed of the impeller 9.

It can be desired, in fact under certain circumstances even required, to have the proportionality factor for the rotational speed $n(n = aQ_L)$ and thus the proportionality factor for the fuel quantity $(Q_L = bQ_K)$ dependent upon external parameters. This can be realized in different ways. In the most simple case, as has been shown in the drawings, a magnetic core 32 can be mounted in teh mixing compartment wall at the height of the vanes 11 preferably formed of magnetically conductive material, and this magnetic core 32 is equipped with a coil 33. By energizing electromagnet 32, 33, defining braking means, with a direct-current which is analogous, for instance, to the values of the external parameters it is thus possible to appropriately regulate the rotational speed of the impeller 9.

Previously there was described, on the basis of a simple constructional exemplary embodiment, only the principal construction and the principal mode of operation of the carburetor apparatus of this development.

Depending upon special requirements with regard to economical fabrication and dosing accuracy there can be undertaken different modifications. Thus, for instance, there can be provided more than two nozzle channels, the nozzle channels also can be positioned in the impeller vanes themselves. There can be additionally installed flow guide plates or sheet metal members, and the nozzle channels also can be bent or curved. Even from these examples it should be readily apparent that with very simple means it is possible to obtain dosing accuracy without difficulty. Apart from the dosing accuracy, due to the rotating nozzle channels there is also already realized in many instances a satisfactory preparation of the fuel-air mixture.

The degree of atomization of the fuel can be improved with the carburetor of the invention in that, as shown in FIG. 2, in front of each injection nozzle or opening 20*a* of the impeller 9 there is provided an atomizer device 40 in order to atomize in the mixing compartment 3 the fuel-spray jets emanating from the injection nozzles. In FIG. 2 the atomizer devices 40 have only been symbolically illustrated, since such, as explained heretofore, can consist of conventional atomizer elements which have been constructionally modified for this purpose, such as typically impact elements, gaps, disks, edges and so forth or combinations of such features. Moreover, it is to be appreciated that the impeller 9 depicted in FIG. 2 is constructed the same as in FIG. 1: the hollow shaft 10 is rotatably mounted at the bottom and top by means of the bearings 12, 13 and 15 supported at webs 14 and 16 respectively, which are secured at the upper housing portion 2, and the vanes 11 of the impeller 9 are secured to the hollow shaft 10 beneath the nozzle channels 20. A somewhat modified construction of impeller and equipped with injection nozzles and an exemplary atomizer device has been schematically shown in FIG. 3.

In the construction of impeller 9 depicted in FIG. 3 the arrangement of the vanes 11 and the nozzle channels 20 at the hollow cylindrical shaft 10 is reversed in relation to the arrangement of FIGS. 1 and 2, i.e., the nozzle channels 20 lead away from the lower portion of the fuel compartment 19 and the vanes 11 are located above such nozzle channels. The injection nozzle or opening 20*a* of each nozzle channel 20 opens into a hollow compartment 41 which is provided at a thickened wall of the hollow shaft 10, each such hollow compartment 41 is open in the direction of the mixing compartment above the associated injection nozzle 20*a* by means of a gap or slot 42. The impeller 9 can be mounted in the mixing compartment 3 in the manner shown for the embodiment of FIG. 1. During rotation of the impeller 9 fuel is dosed out of the injection nozzles 20*a* into the hollow compartments 41 and then is atomized by the slots or gaps 42 into the mixing compartment 3. Each gap 42 can extend horizontally or can be inclined i.e. slanted with respect to the horizontal. Instead of providing a separate hollow compartment 41 and gap 42 for each nozzle channel 20 there also can be provided a ring-shaped or annular compartment common to all of the nozzle channels and equipped with an annular or ring-shaped gap.

FIG. 4 illustrates a practical exemplary embodiment of carburetor equipped with an impeller, nozzle channels and an atomizer device. The carburetor housing, as is conventional with standard carburetors, and as heretofore discussed advantageously may possess a cylindrical upper housing portion 2 which merges via the conical intermediate portion 4 with the valve support or valve support means 5 of smaller diameter. The upper housing portion 2 encloses the mixing compartment 3 and contains the impeller 9. At the valve suport 5 there is again accommodated the regulating valve or flap 8 which can be adjusted about the axle or shaft 7. The upper housing portion 2 contains, at the region of the impeller 9, a substantially ring-shaped insert 47, preferably formed of a fuel-repelling material, for instance "TEFLON," by means of which the housing diameter at the region of he impeller 9 can be reduced to the inner diameter of the valvve support 5, so that the sucked-up air has imparted thereto a greater velocity and the impeller 9 rotates quicker during idling. Above the regulating valve or flap 8 there are secured in the housing 1, for instance three radial webs 14, one of which can be constructed as a fuel-infeed or delivery line or conduit 18. A tubular element 34 is mounted at the radial webs so as to be substantially coaxially arranged with regard to the lengthwise axis of the mixing compartment 3, this tubular element being in flow communication with the fuel-delivery line or conduit 18 and serving as the axis of rotation for the impeller 9. Two ball bearings 35 are pushed onto the tubular element 34. As shown in the drawing, at the upper end the tubular element 34 is reduced to a smaller external diameter while forming a continuous circular shoulder or stepped end 34*a*.

The impeller 9 possesses a hollow shaft 10 which fits onto the ball bearings 35. This hollow shaft 10, in the illustrated exemplary embodiment, is closed at the top by means of a semi-spherical-shaped end wall 38. Beneath the end wall 38 there is located the fuel compartment 19 of the impeller 9, which compartment is closed at the bottom by means of a ring or annular disk 36 which is secured within the hollow shaft 10. The internal diameter of the ring-shaped or annular disk 36 is only slightly greater than the external diameter of the stepped end of the tubular element 34, so that with the shaft 10 seated on the ball bearings 35 the ring-shaped or annular disk 36 surrounds the upper end of the tubular element 34 with a small amount of play and fuel can be introduced into the rotating fuel compartment 19 by means of the fuel-infeed line 18 and the tubular element 34. The ring-shaped or annular disk 36 advantageously possesses a surface which repels fuel and at its side or face which is located at the fuel compartment 19 is provided with radial grooves 37, whereby, — together with the slight play between the disk 36 and the tubular element 34 — there is insured that during operation no fuel can arrive via the ball bearings 35 in the mixing compartment 3 and the fuel will be rotatably entrained in the fuel compartment 19 during rotation of the impeller. The annular disk 36 is also advantageously formed of "TEFLON." In the substantially cylindrical wall of the fuel compartment 19 there are provided radial bores serving as the nozzle channels 20. The atomizer device 40 consists of an essentially cylindrical ring member 43 secured to the hollow shaft 10. At the upper portion the ring member or ring-shaped attachment 43 possesses a continuous ring-shaped recess 43*a*, so that there is provided a ring-shaped hollow compartment 46 between the ring member 43 and the hollow shaft 10 and which opens in the direction of the mixing compartment 3 by means of an annular or ring-shaped gap or slot 45. The nozzle channels 20 open into the hollow compartment 46. The end surface 44 of the ring or ring member 43 which is located in a plane perpendicular to the lengthwise axis of the hollow shaft 10 has a certain influence upon atomization of the fuel, whereby for the relevant carburetor construction by varying the width of the end surface, the position of the end surface with regard to the nozzle channels and the surface properties of the end surface, it is possible to obtain optimum conditions. The width of the annular or ring-shaped gap 45 essentially determines the particle size of the atomized fuel and amounts to, for instance, 0.1 millimeters. For the fine adjustment of the carburetor there is provided at the apex or crown of the semi-spherical-shaped end wall 38 of the fuel compartment an air nozzle 39. In the embodiment of carburetor depicted in FIG. 4, the vanes 11 of the impeller 9 are arranged at the hollow shaft 10 beneath the nozzle channels 20, so that, like the embodiment corresponding to FIG. 2, the atomized fuel passes the rotating vanes 11. Instead of this construction it would be possible, in accordance with the showing of FIG. 3, to also arrange the vanes 11 above the nozzle channels.

The fuel-delivery line 18 leads to a compensation compartment 21 designed in conventional manner for the purpose of maintaining a fuel level therein which is located slightly below the floor of the fuel compartment 19.

As soon as the impeller 9 begins to rotate by virtue of the action of the sucked-up air current, then fuel arrives from the fuel-delivery line 18 and the tubular element 34 at the fuel compartment 19, from that location flows through the nozzle channels 20 into the ring-shaped hollow compartment 46 and out of such through the annular or ring-shaped gap 45 and over the end surface 44 in the form of a screen-like spray mist or cloud and into the mixing compartment 3. The gap 45 can be dimensioned for the desired droplet size independent of the fuel dosage, so that, possibly arising local clogging of the ring-shaped gap does not impair the operational reliability of the carburetor.

Figure 5:
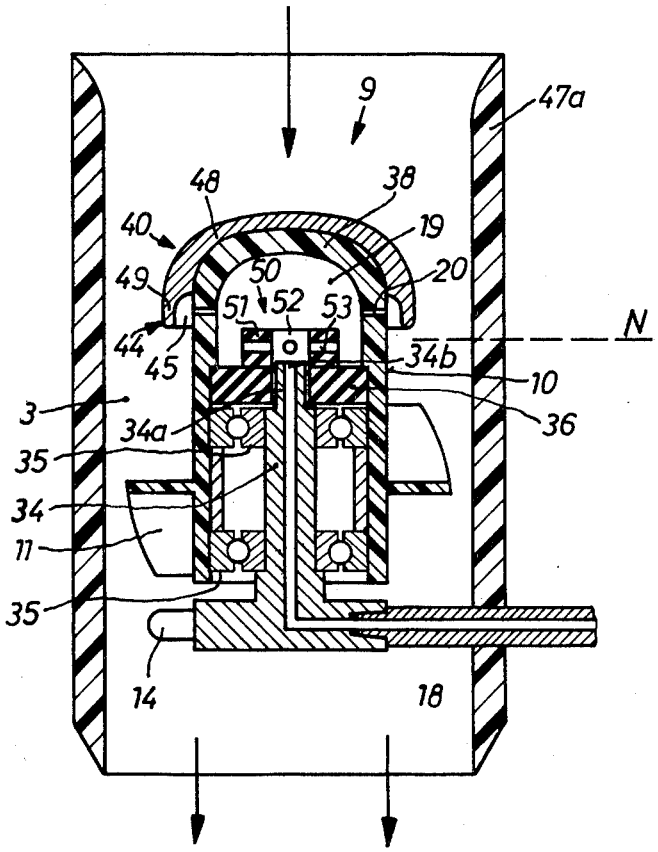
FIG. 5 is a sectional view of a further embodiment of carburetor equipped with a conveying or feed pump for delivering fuel into the fuel compartment of the impeller, the feed pump being in the form of a ring equipped with radial bores.

In the exemplary embodiment of carburetor depicted in FIG. 5 the hollow shaft 10, which is closed at its upper end by a rounded end wall 38, and the vanes 11 of the impeller 9 are formed of one piece, i.e. integrally from plastic. The nozzle channels 20 are constituted by radial bores provided in the walls of the hollow shaft 10. In this case the atomizer device 40 consists of a cap 48 secured to the end wall 38 of the hollow shaft 10, the edge 49 of the cap forming a ring-shaped or circular extending lip member located at the height of the nozzle channels 20. The radius of the rounded end surface 44 of the cap edge 49 and the size of the ring-shaped or annular gap 45 between the lip member and the hollow shaft are decisive for the size of the atomized fuel particles. In the hollow shaft 10 there is inserted a ring-shaped disk 36 defining an intermediate wall in order to delimit the fuel compartment 19, which is located at the closed hollow shaft end, from the lower open portion of the hollow shaft. In a plastic sleeve 47*a*, constructed to be inserted into the air suction conduit of the engine, there is secured upon the radial webs or struts 14, one of which forms a part of the fuel delivery channel i.e. the fuel delivery line 18, a tubular element 34. This tubular element 34 is substantially coaxially arranged with respect to the sleeve 47*a* and constitutes the axis of rotation for the impeller 9. Tubular element 34 carries two ball bearings 35 onto which there is pushed the hollow shaft 10 of the impeller 9 to such an extent that the upper, stepped end 34*a* of the tubular element 34 is located at a central opening of the ring-shaped disk 36, and between the ring-shaped partition disk 36 and the tubular element end 34*a* there is just provided a sufficient amount of intermediate space or play that the impeller 9 can freely rotate, but however there is prevented leakage of fuel. The outer surface of the end 34*a* of the tubular element 34 is advantageously designed so as to repel fuel, as such is also possible for the embodiment of FIG. 4. Also the surface of the ring-shaped disk 36 confronting the fuel compartment 19 may be designed to be fuel repellant.

Within the fuel compartment 19 there is secured a conveying or feed pump 50 on the ring-shaped disk 36, the feed pump 50 merely having the function, even when the impeller 9 rapidly rotates, to supply the fuel compartment 19 with a sufficient quantity of fuel from the outlet or discharge opening 34*b* of the tubular element 34 which is operatively connected with the fuel delivery line 18.

In the exemplary embodiment depicted in FIG. 5 the conveying or feed pump 50 comprises a cylindrical ring or ring member 51 formed of plastic, whose inner wall, which is in alignment with the central opening of the ring-shaped disk 36, laterally limits a suction of the fuel compartment. A number of radial bores 53 are provided in the ring 51 and through such bores the fuel is delivered into the fuel compartment 19. The ring 51 and the ring-shaped disk 36 can be easily fabricated as a platic part or component.

Within the fuel compartment 19 the bores 53 are situated lower than the nozzle channels 20 and the level of the fuel is adjusted to a level N which is approximately located at the height of the bores 53.

Figure 6:
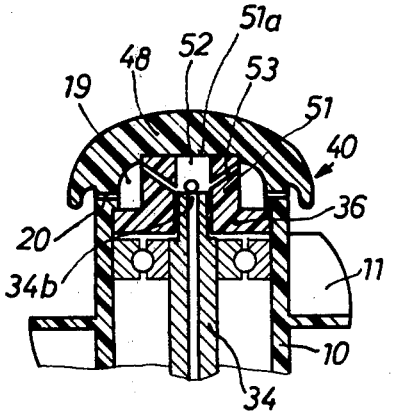
FIG. 6 is a fragmentary sectional view through the portion of the impeller containing the fuel compartment and equipped with a ring-shaped conveying pump according to a further exemplary embodiment.

Such simple type of conveying or feed pumps possessing a ring-shaped body with lateral bores can be randomly modified for the herein contemplated purposes. Thus, with the modified exemplary embodiment depicted in FIG. 6 the hollow shaft 10 and the cup-shaped atomizer device 40 as well as the vanes 11 of the impeller 9 are fabricated of one-piece from plastic. The pump ring 51, which is loacted in a higher elevational position than in the arrangement of FIG. 5, is disposed such that its end surface 51*a* sealingly bears against the inner wall of the hollow shaft cap 48, as shown, so that the fuel commpartment 19 has a ring-shaped configuration and the suction compartment 52, which is closed at the top, only communicates via the bores 53 extend from the suction compartment 52 at a location near and above the outlet opening 34*b* of the tubular element 34, upwardly at an inclination in the fuel compartment 19, and the nozzle channels 20 are located lower than the bores 53. In this case the fuel level can be less accurately adjusted and the fuel flows along the inner wall of the hollow shaft 10 downwardly to the nozzle channels 20.

Figure 7:
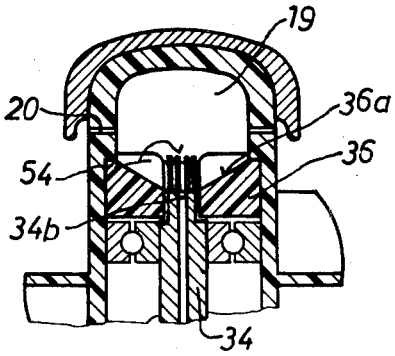
FIG. 7 is a cross-sectional view of a fuel compartment and a conveying pump equipped with blades or buckets.

Finally, in FIG. 7 there is illustrated a further exemplary embodiment of conveying or feed pump equipped with buckets or blades. The end surface 36*a* of the ring-shaped disk 36 which is located in the fuel compartment 19 is conical, so that the fuel compartment 19 possesses a floor which ascends from the outlet opening 34*b* of the tubular element 34 in the direction of and towards the hollow shaft wall. The conical end surface 36*a* carries radial webs serving as pump buckets or blades 54 and which are formed at the ring-shaped disk 36 so as to form a bucket wheel means for the pump. Also with such modified construction of fuel feed pump there are equally possible a number of different alterations and changes.

Equipping the ring-shaped disks 36 with conveying pumps of the previously described exemplary types only requires a very small amount of additional expenditure, which is hardly great in terms of the overall fabrication costs.

A particular advantage of the various embodiments of carburetor constructions which have been described herein purely by way of example, resides in the fact that there can be attained optimum preparation of the mixture, not by adjusting certain elements, for instance nozzles, rather by constructional measures, so that there is insured for a continuously constant mode of operation.

While there is shown and described present preferred embodiments of the invention, it is to be distinctly understood that the invention is not limited thereto, but may be otherwise variously embodied and practiced within the scope of the following claims.

What is claimed is:

1. A carburetor for an Otto cycle engine comprising means defining a mixing compartment through which flows a suction air current, regulating valve means for regulating said suction air current flowing through said mixing compartment, nozzle means cooperating with said mixing compartment for dosing fuel delivered to said mixing compartment for preparing the fuel-air mixture for the Otto cycle engine, an impeller driven by said suction air current arranged within said mixing compartment, said impeller being provided with a fuel compartment, a fuel delivery channel opening into said fuel compartment, said nozzle means including nozzle channels leading away from said fuel compartment, said nozzle channels rotating with said impeller, said nozzle channels including injection nozzles which during rotation of the impeller inject the fuel out of the fuel compartment into the mixing compartment due to the action of excess pressure brought about by centrifugal force, an atomizer device arranged forwardly of each injection nozzle of the impeller in order to atomize spray jets of fuel emanating from the injection nozzles in the mixing compartment, said atomizer device embodying a hollow compartment provided in front of each injection nozzle, said hollow compartment opening into the mixing compartment via a gap, each said injection nozzle opening into said hollow compartment, said hollow compartment comprising a substantially ring-shaped compartment into which open all of the injection nozzles of the fuel compartment, said gap being a substantially ring-shaped gap, and wherein the ring-shaped hollow compartment opens into the mixing compartment via said ring-shaped gap.

2. The carburetor as defined in claim 1, wherein the fuel compartment has an axis of rotation, the ring-shaped gap of the atomizer device is located in a plane which is substantially perpendicular to the axis of rotation of the fuel compartment.

3. the carburetor as defined in claim 2, wherein the ring-shaped gap is bounded at the outside by an annular end surface of predetermined width and which is located at said plane wherein there is located the ring-shaped gap.

4. The carburetor as defined in claim 3, wherein the impeller comprises a substantially cylindrical hollow shaft, means for closing said hollow shaft at one end, an intermediate wall located at the region of the closed end of the hollow shaft for separating said fuel compartment, said fuel delivery channel including a fuel delivery line opening into said fuel compartment, said nozzle channels being defined by radial bores provided at a jacket wall of the fuel compartment, the substantially cylindrical hollow shaft of the impeller carrying at the region of the nozzle channels a substantially ring-shaped attachment with a substantially ring-shaped continuous inner recess which forms the ring-shaped hollow compartment and the ring-shaped gap.

5. The carburetor as defined in claim 4, wherein said fuel delivery line includes a tubular element which is substantially coaxially arranged with respect to the mixing compartment, means for rotatably mounting said impeller in the mixing compartment with its hollow shaft at said tubular element, the closed end of the hollow shaft together with the fuel compartment being directed upwardly towards the inflowing suction air current, and wherein the end of the tubular element of the fuel delivery line is guided with play through the intermediate wall separating the fuel compartment in the hollow shaft.

6. The carburetor as defined in claism 5, wherein said intermediate wall possesses a fuel-repelling surface.

7. The carburetor as defined in claim 6, wherein the intermediate wall is provided with grooves at the side thereof located in the fuel compartment.

8. The carburetor as defined in claim 7, wherein said grooves comprise radially extending grooves.

9. The carburetor as defined in claim 5, wherein said rotatably mounting means comprises ball bearing means.

10. The carburetor as defined in claim 5, further including an air nozzle for the purpose of carrying out of a fine adjustment provided for the fuel compartment.

11. The carburetor as defined in claim 5, wherein said impeller is provided with vanes, said vanes of the impeller being arranged at the hollow shaft above the nozzle channels at the region of the fuel compartment, the fuel compartment being extendted in axial direction.

12. The carburetor as defined in claim 1, wherein the fuel compartment has an axis of rotation, the ring-shaped gap of the atomizer device is located in a substantially cylindrical jacket surface which is substantially coaxially arranged with respect to the axis of rotation of the fuel compartment.

13. A carburetor for an Otto cycle engine comprising means defining a mixing compartment through which flows a suction air current, regulating valve means for regulating said suction air current flowing through said mixing compartment, nozzle means cooperating with said mixing compartment for dosing fuel delivered to said mixing compartment for preparing the fuel-air mixture for the Otto cycle engine, an impeller driven by said suction air current arranged within said mixing compartment, said impeller being provided with a fuel compartment, a fuel delivery channel opening into said fuel compartment, said nozzle means including nozzle channels leading away from said fuel compartment, said nozzle channels rotating with said impeller, said nozzle channels including injection nozzles which during rotation of the impeller inject the fuel out of the fuel compartment into the mixing compartment due to he action of excess pressure brought about by centrifugal force, said injection nozzles delivering a quantity of fuel therefrom which varies substantially as a function of the square root of the excess pressure in the fuel compartment, an atomizer device arranged forwardly of each injection nozzle of the impeller in order to atomize spray jets of fuel emanating from the injection nozzles in the mixing compartment, wherein the impeller includes a substantially cylindrical hollow shaft, means for closing said hollow shaft at one end, an intermediate wall located at the region of the closed end of the hollow shaft for separating said fuel compartment, said fuel delivery channel including a fuel delivery line opening into said fuel compartment, and said nozzle channels are defined by raidal bores provided at a jacket wall of the fuel compartment, and wherein said fuel delivery line has an outlet opening, a conveying pump rotating with said hollow shaft and arranged in the hollow shaft of the impeller at the intermediate wall separating the fuel compartment, said conveying pump having a suction compartment in which there is located the outlet opening of the fuel delivery line.

14. The carburetor as defined in claim 13, wherein the conveying pump comprises a substaantially ring-shaped pump component which surrounds said outlet opening, said ring-shaped pump component containing a substantially ring-shaped opening defining a pump suction compartment containing lateral bores leading into the fuel compartment.

15. The carburetor as defined in claim 14, wherein the conveying pump comprises bucket wheel means substantially coaxially arranged with respect to the outlet opening, and wherein the intermediate wall comprises a ring-shaped disk, said ring-shaped disk together with the conveying pump defining a one-piece plastic part.

16. The carburetor as defined in claim 13, wherein the conveying pump comprises bucket wheel means substantially coaxially arranged with respect to the outlet opening.

* * * * *